United States Patent [19]

Stewart

[11] 4,435,961

[45] Mar. 13, 1984

[54] METHOD AND APPARATUS FOR AUTOMATICALLY SYNCHRONIZING MULTIPLE ENGINES

[76] Inventor: Glenn D. Stewart, 210 Bayview Ave., Massapequa, N.Y. 11758

[21] Appl. No.: 218,063

[22] Filed: Dec. 19, 1980

[51] Int. Cl.[3] ..... F02B 73/00

[52] U.S. Cl. ..... 60/719; 60/698; 74/470; 74/501 R; 74/531

[58] Field of Search ..... 60/698, 700, 702, 711, 60/716, 719; 74/470, 501 R, 501.5 R, 531

[56] References Cited

U.S. PATENT DOCUMENTS

| | | | |
|---|---|---|---|
| 1,304,955 | 5/1919 | Fowler | 74/470 X |
| 2,071,785 | 2/1937 | Ehrlich | 74/470 X |
| 2,087,291 | 7/1937 | Moross | 60/700 |
| 3,223,201 | 12/1965 | Waner | 74/531 X |
| 3,986,363 | 10/1976 | Beaman et al. | 60/702 X |

*Primary Examiner*—Allen M. Ostrager
*Assistant Examiner*—Stephen F. Husar
*Attorney, Agent, or Firm*—Bauer & Amer

[57] ABSTRACT

An apparatus for synchronizing the operation of one or more slave engines with that of a master engine in which a servomechanism automatically controls the operation of the slave engines to synchronize them with the master engine while each slave engine and master engine remains directly connected with a manually operable throttle to provide for concurrent operation and overcontrol of the engines so as to dominate the operation of the slave engines by the servomechanism.

16 Claims, 6 Drawing Figures

METHOD AND APPARATUS FOR AUTOMATICALLY SYNCHRONIZING MULTIPLE ENGINES

The invention relates to synchronizing apparatuses, but more particularly it refers to an apparatus that permits the constant ability to manually overcontrol the mechanisms or engines synchronized by the synchronizing apparatus.

Asynchronous operation of two or more mechanisms or engines used on boats, aircraft and the like produces vibrations and vibrational effects that occur at different frequencies resulting from the differences in the speeds of the engines. Thus, in any use of two or more engines it is desirable to adjust or phase the operations of the engines such that they operate in synchronism with each other.

Elaborate attempts at solving the problem of synchronizing plural engines have included the use of complicated mechanisms connected between the engines. Although such attempts also included efforts to provide for manual overcontrol of the synchronizing apparatus to enable the user to correct a potentially hazardous or dangerous condition that may occur as a result of some malfunction, the apparatuses have been complicated and expensive and have required extensive technical expertise to install and use.

The desideratum of the present invention is to provide a fail-safe multi-engine synchronizing apparatus that enables automatic phasing control of one or more engines to affect their synchronous operation with an other or master engine while assuring that during all phases of automatic engine control the same are subject to the fail-safe overcontrol of the user.

Another object of the invention is to provide a synchronizing apparatus for engines and the like that is simple in construction so as to enable it to be linked between the slave engine and its usual manual throttle control for automatic synchronization of the engine with a master engine while, at the same time, affording the user complete fail-safe dominating control of the slave engine by way of its manual throttle.

Still another object of the invention is to provide a synchronizing apparatus that may be adapted for use with any engine by simple inexpensive modification of the engine control structure so that it requires no replacement of the operating controls of the engine.

Other features and objects of the invention reside in the simple inherent arrangement of structures that preclude any possibility that the automatic synchronizing apparatus of the present invention ever will dominate or prevent the manual overcontrol of the engine.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

Figure 1:
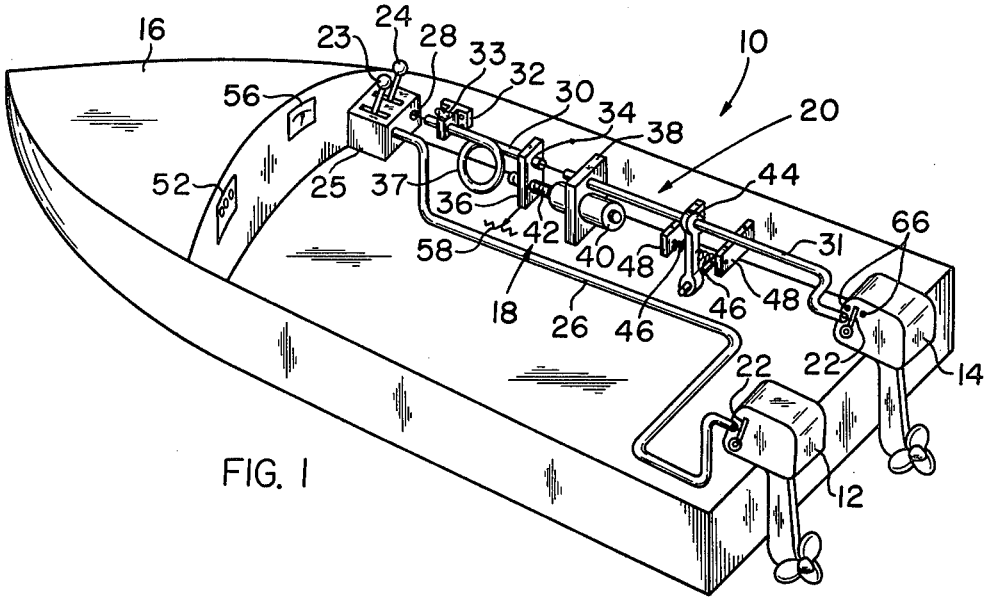
FIG. 1 is a schematic view showing the synchronizing apparatus of the present invention as applied to a slave and master engine.
Figure 2:
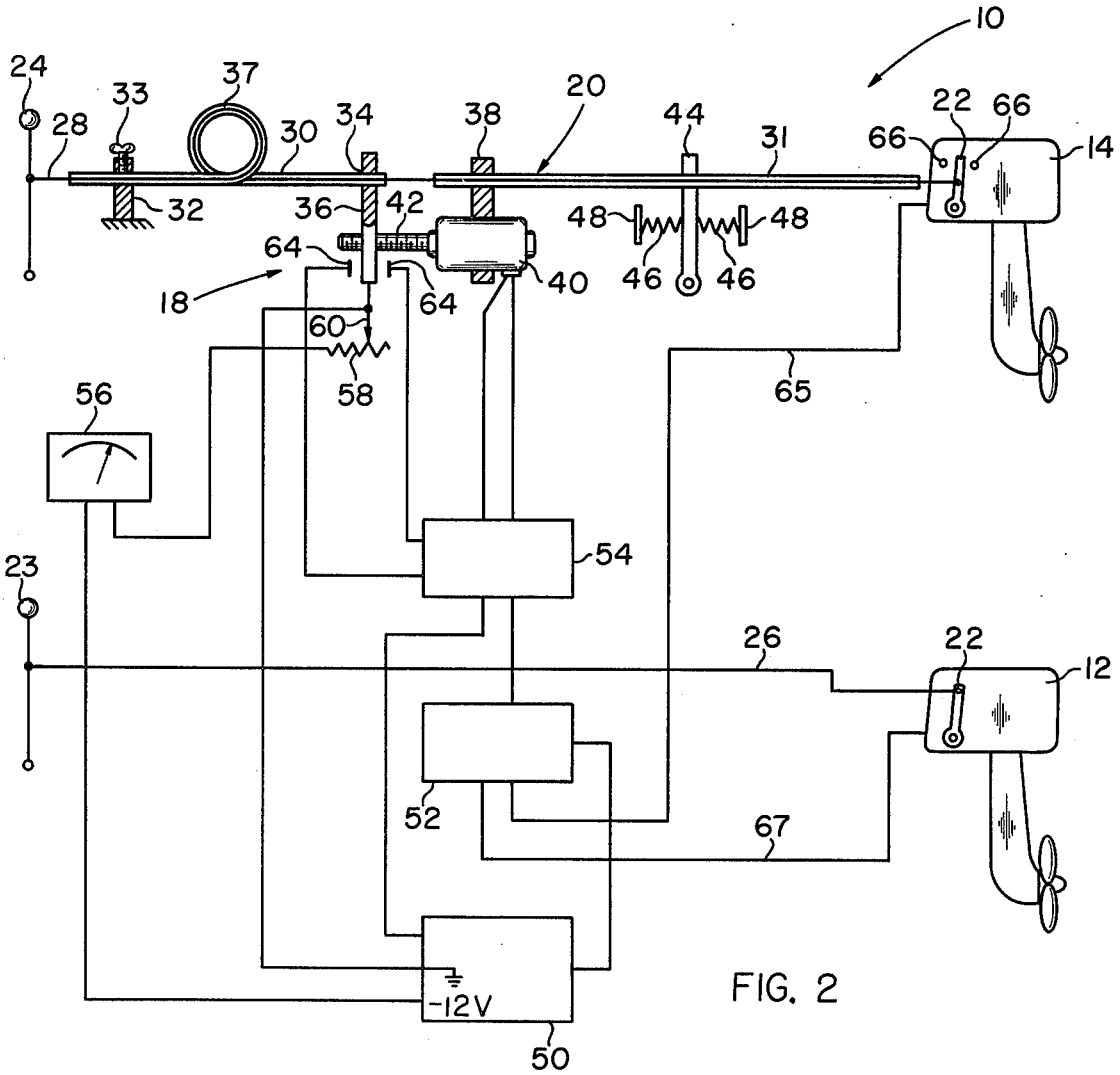
FIG. 2 is a diagrammatic view of the synchronizing apparatus of FIG. 1.

Referring to FIGS. 1 and 2 of the drawing, the embodiment of the synchronizing apparatus there shown is generally identified by the numeral 10. The details of the apparatus 10 shown in diagrammatic form in FIG. 2 are illustrated in one exemplary manner of use in FIG. 1. The application of the apparatus 10 for use with multiple drivers or engines 12 and 14 of the boat 16 is made solely to enable an easier description and understanding of the invention. The illustration of the boat 16 is not to be deemed limiting upon the scope of the invention since it is apparent that the use of the present invention is capable of being employed for synchronizing multiple engines and related mechanisms on aircraft and the like.

Liberty has been taken in the schematic illustration of the boat 16 and the arrangement of the details of the synchronizing apparatus 10 as shown mounted therein solely for the purpose of enabling the reader to more fully understand the function of the synchronizing apparatus rather than to illustrate its specific required arrangement within the boat structure 16. Any person skilled in the art should be readily able to recognize that any other arrangement of the structural details of the apparatus 10 may be made within the boat or in an aircraft or other like vessels or vehicles to enable the use of the inventive apparatus 10.

The apparatus 10 comprises a servomechanism or automatic means generally identified by the numeral 18 and an operative phase controller or connector generally identified by the numeral 20. In the use of the apparatus 10 for automatically synchronizing the operation of the engines 12 and 14, one of the engines is utilized as the "master" while the other is denominated the "slave". In the application of the present inventive apparatus 10 for the synchronization of a plurality or multiplicity of engines, the master engine is used as the standard for the synchronous control of the slave engines. For convenience of explanation, only one slave engine will be referred to in this disclosure and will be described to be automatically synchronously phased with the master engine 12 by the apparatus 10. If more than one slave engine 14 is employed, they too will be automatically synchronized with the master engine 12 by similar separate apparatuses 10 in the manner to be described with respect to the one slave engine 14.

As is conventional with engines and like drivers, each has its own engine throttle 22 that is directly connected with and controlled from a remote location by a respective manual throttle 23 for the master engine 12 and by the throttle 24 for the slave engine 14. The throttles 23 and 24 are generally supported in a guadrant or housing 25 and manually operated by the pilot or user of the boat or aircraft to adjust the engines 12 and 14 for synchronous operation. Because of the direct connection made between the engine throttle 22 and its respective manual throttle 24, each engine is constantly subject to the dominating overcontrol of the pilot or user.

The apparatus 10 continues the pilot's or user's intimate right of absolute domination and overcontrol of the engine operation even after the same is connected for automatic synchronizing control of the slave engine 14 and even while the slave engine 14 is being synchronously controlled by the apparatus 10. To this end the apparatus 10 is connected only with those slave engines 14 to be synchronously phased with the master engine 12. This description is made easier because the illustration of FIG. 1 of the boat 16 shows only one slave engine 14 with the apparatus 10 connected with it.

The master engine 12 retains its conventional cable connection 26 between its manual throttle 23 and its engine throttle 22. The details of such cable connection 26 form no part of this invention except that it may be noted that any convenient flexible cable may be used for such purposes. In the past Bowden cables have been conveniently used for this purpose. A Bowden cable has a flexible wire that is connected directly across the two throttles 23 and 22 and is covered by a flexible covering sleeve-like housing or sheath. Because the details of the Bowden cable do not form a part of this invention, the same are not here shown.

The connecting means 20 for the slave engine 14 shown in the embodiment of FIGS. 1 and 2 includes an elongated element 28 that extends directly between the manual throttle 24 and the engine throttle 22 of the slave engine 14. This direct connection 28 assures the pilot or user of constant and dominant control over the synchronous or asynchronous operation of the slave engine 14. In its simplest form the element 28 may be a flexible cable of uninterrupted wire form or of any other structural material or configuration.

The element 28 is enclosed, at least for a portion or portions of its length, within a covering sleeve-like housing or sheath that is interrupted and formed in two parts 30 and 31. The part 30 is fixedly supported at its one end proximate the manual throttle 24 in a support 32. In practice, the quadrant or housing 25 may have a brake type adjustment to apply a holding or restraining braking force against the throttles 23 and 24 to restrain and hold the same against movement, other than that physically applied by the user, as in an emergency. Such adjustable restraining or braking means is here illustrated in a different form for convenience of description by the wing screw 33 adjustable in the support 32. When the screw 33 is tightened, it will compress the sheath 30 into tighter frictional engagement with the cable 28 to restrain or brake its movement against undesired or accidental displacement, and vice versa.

The sheath part 30, with the operator or controller cable 28 passing therethrough, is physically connected at its end 34 remote from its support 32 with a traveller member 36 forming a part of the servo means or automatic mechanism 18 for movement by and with the traveller. The sheath part 30 and its interior cable 28 are provided with a slack or slight looseness intermediate the fixed support 32 and the movable connection 34.

The looseness is illustrated by the loop 37. The loop 37 is merely intended to suggest to the reader that the sheath part 30 and its interior cable 28 are not tautly connected between the mountings 32 and 34. The extent of the looseness or slack in the sheath part 30 and cable 28 between the support 32 and the connection 34 is not critical, but as will become apparent it is sufficient to provide for some lost motion movement of the sheath part 30 and its cable 28 therein when the same are moved by the traveller 36.

The second covering sheath 31 is slidable about and movable lengthwise along and relative to the cable 28. Connected for movement with the sheath 31 is a support 38 that suspends and mounts an operating drive motor 40 for rotating its threaded operating shaft 42 along which the traveller 36 is caused to move and by which the same is actuated. Because the sheath part 31 has its interior surface in snug surrounding frictional engagement with the cable positioned therewithin, both the sheath 30 and the cable 28 tend to move with each other upon the movement of either one or the other.

Resisting such conjoint movement is a yieldable restraining mechanism that includes a pivotal arm 44 that also is fixedly connected with the sheath 31 for conjoint movement therewith. The arm 44 is retained in a normally centered position by oppositely disposed urging means in the form of springs 46 that are retained in their opposed positions by supports 48. The equal forces applied by each of the springs 46 retain the arm 44 in its normal neutral position and thereby normally restrain the second sheath part 31 from movement with the cable 28, except when the force applied to the manual throttle 24 and its cable 28 exceeds that of the urging means 46. In such case the covering sheath 31 will slide conjointly with the cable 28 and move the arm 44 with it.

The servomechanism or automatic means 18 is illustrated in its simplest form as including the support 38, the drive motor 40, the threaded shaft 42 and the traveller 36. The motor 40 is operated in response to an asynchronous condition existing between the master engine 12 and the slave engine 14. The motor 40 is connected with any suitable power source as a battery 50 that supplies operating power to a synchronization sensor and comparator 52 and to a control amplifier 54 for the operator control of the motor 40. In practice it has been found that a Guest Model No. 1500 synchronization sensor-comparator sold by Guest Corporation of West Hartford, Connecticut may be utilized as the sensor-comparator member 52.

In operation, when power from the source 50 is turned on, a circuit is also closed to a range indicator 56 having a rheostat 58 whose resistance is varied by a movable contact 60 conveniently forming a part of the traveller 36. The range indicator 56 provides a visual indication of the servomechanism correction of the slave engine 14. This may be an indication of the speed, the rpm, the torque value of the engine or any other selected function of the engine 14. Each slave engine 14 may be provided with its own similar range indicator 56.

After power is turned on, the master engine 12 is manipulated by the pilot or user to a desired setting by the movement of the throttle 23. The throttle of the slave engine 14 is then moved and adjusted under the influence and in accordance with the operating manipulation of its respective manual throttle 24 by way of the through connecting cable 28, thereby causing the slave engine 14 to operate in synchronism with that of the master engine 12. The automatic operations of the engines may be visually viewed by the pilot or user at the range indicator 56.

After the engines 12 and 14 have been set manually by the user into approximate synchronization with each other, the restraining brakes as at 33 are applied to the respective throttles 23 and 24 to restrain them from further accidental movement or adjustments. The range indicator 56 and the comparator 52 thereafter enable the pilot or user to observe how and whether the engines 12 and 14 are operating synchronously. Thereafter the servomechanism or automatic means 18 will operate automatically to synchronize the slave engine 14 and to retain it in synchronism with the operation of the master engine 12.

This is accomplished automatically when the sensor-comparator 52, connected with both the slave and master engines at 65 and 67, senses an asynchronous change in operation. The comparator 52 may be connected with the master and slave engines to sense and compare their respective operations. When a change is sensed in the condition of one of the engines, the comparator 52 will signal the motor amplifier 54 to operate the drive motor 40 to operate the motor and to thereby rotate its threaded shaft 42 to move the traveller 36 relative to the support 38. The motor 40 and its support 38 are restricted from torsional rotation about the axis of the cable 28 by the snug frictional engagement between the sheath 31 and the cable. At the same time a visual indication of the operating condition of the motor 40 and engine 14 may be seen by the pilot or user by viewing the range indicator 56 and the comparator indicator 52.

In the event the slave engine 14 is operating slower with respect to the master engine 12, the motor 40 will rotate the screw shaft 42 to move the traveller 36 and its connected sheath 30 toward the engine 14 and the relatively spaced support 38 connected with the sheath part 31. Because the manual throttle 24 of the slave engine 14 is braked or restrained against movement from its set position, the movement of the sheath 30 reduces the length of the cable 28 within the sheath 30. This movement occurs at the loose or slack location along the length of the sheath 30 and the cable 28. In the present case it will occur at the lost motion loop 37 which permits the movement of the cable 28 in the direction of the engine 14 through the sheath 31. This movement of the cable 28 relative to and within the sheaths corresponds to the relative movements of the traveller 36 and support 38 and correspondingly moves the engine throttle 22 to increase the engine operation into synchronism with that of the master engine 12.

The movement of the cable 28 by the controlled automatic operation of the drive motor 40 will terminate when the comparator 52 senses that the engines 12 and 14 are once again operating in synchronism. Any relative increase in the speed of operation of the slave engine 14 with respect to the master engine 12 will also be sensed by the comparator 52. When this occurs it will initiate operation of the drive motor 40 for a required period to move the traveller 36, the connected sheath 30 and the inner cable 28 relative to and away from the support 38 to operate the slave engine throttle 22 to the left to slow the slave engine 14 the required amount to bring it into synchronous operation with that of the master engine 12.

To assure against the failure of the servomechanism 18 and possible uncontrolled operation by it of the slave engine 14, breaker switch contacts 64 may be positioned on opposite sides of the traveller 36 for contact thereby in the event the traveller is caused to move beyond safe points of motor control. If the traveller 36 moves into an unsafe condition, it will complete a circuit across one of the contacts 64 thereby resulting in the interruption of the power supplied by the power source 50 and in the consequent interruption of the operation of the motor controller 54 and its related servomechanism 18. Additional stops 66 are conventionally provided to limit the movements of the engine throttle 22 of the slave engine 14 to prevent possible overthrow or excessive movement of the slave engine throttle 22.

To fully assure safe operation and control of the slave engine 14 at all times, and especially during the concurrent automatic control of the engine by the servomechanism 18, the manual throttle 24 always remains in direct connection with the engine 14 through the connecting structure 20 by the cable 28. Hence, both the controlled automatic operation of the engine 14 and the dominant ability to manually overcontrol the engine 14 by the throttle 24 is accomplished through the same medium, namely, the cable 28. This enables the pilot or user to overcontrol the operation of the engine 14 even at such times as the engine 14 is being concurrently controlled in its operation by the servomechanism 18.

Should the user need to overcontrol the operation of the servo 18 and the engine 14, he may do so without the need to terminate the servomechanism by opening the power circuit at 50 that will immediately disconnect the servomechanism 18 from its controlled automatic operation of the slave engine 14. If the servomechanism 18 is electrically disabled or disconnected, the pilot is then free to use the throttle 24 of the slave engine 14 in the same manner as though the servomechanism 18 had not been interposed in connection with the slave engine 14. On the other hand, because the pilot or user is capable of dominating or overcontrolling the servomechanism 18 and its effects upon the slave engine 14, he may, if he wishes, simply operate the throttle 24 with a force sufficient to overcome the braking force applied to its movement at the adjustable restraining means 33.

If the overcontrolling or dominating operation of the throttle 24 is made while the servomechanism 18 is also operating the engine throttle 22 of the slave engine 14 in the same direction as the manual throttle 24, the absorber or yielding means 44 and 46 will permit continued movement of the manual throttle 24. The forces applied by the yieldable springs 46 against the pivotal arm 44 are normally sufficient to equal the sum of the forces applied to the cable 28 by the servomechanism 18 and by the normal operation of the manual throttle 24. However, the springs 46 will yield in response to an overcontrolling force applied by the manual throttle 24 to the cable 28 should such force that is applied to the manual throttle 24 exceed the resistance of the springs 46. Thus, if during the automatic or manual control of the engine 14 the throttle 22 abuts against one of the stops 66, further thrust applied to the cable by the manual throttle 24 will be absorbed by the yielding structure 44 and 46 connected for movement with the sheath 31.

If an excessive thrust is applied to the cable 28 by the manual throttle 24 and the throttle 22 of the slave engine 14 is stopped in its movement by its abutting engagement with one of the stops 66, the excessive force applied to the manual throttle 24 will cause the arm 44 to pivot against that spring 46 resisting or opposing the direction of the thrust of the cable 28. As a result the spring will yield and compress thereby enabling the arm 44 to pivot in the direction opposite of the applied thrust. This will enable the sheath part 31 that is conjointly movable with the arm 44 to move with the cable because the sheath 31 is in encompassing frictional engagement with the cable along the full interior length of the sheath 31. In this way if the forces applied to move the cable 28 exceed the resistance of the yielding means 46, damage to the engine throttle 22 and the mechanism of the slave engine 14 will be avoided by the absorption of the excessive thrust afforded by the yielding mechanism 44 and 46.

Figure 3:
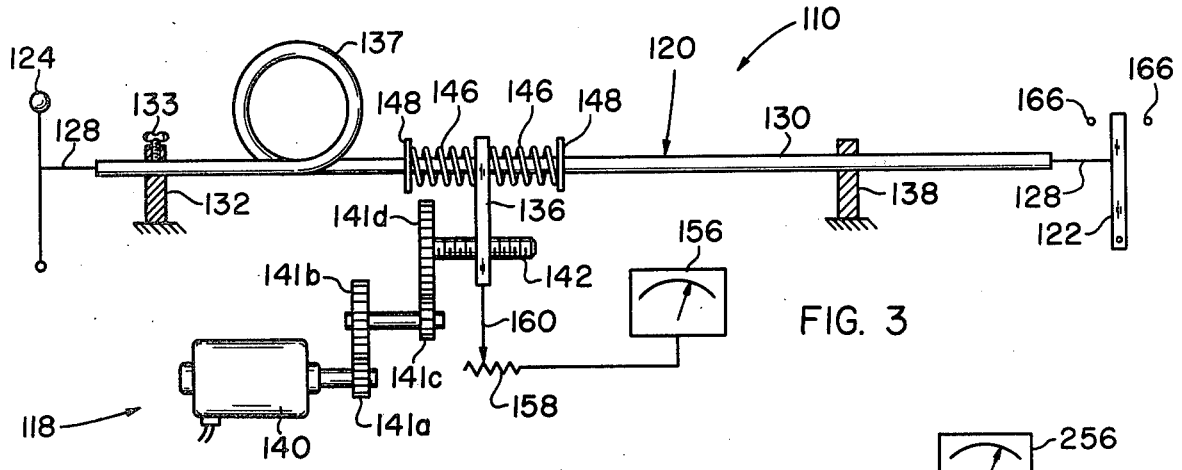
FIG. 3 is a diagrammatic view of another synchronizing apparatus.

The embodiment of the synchronizing apparatus of FIG. 3 is generally identified by the numeral 110. Because the same includes details that are generally related to that already described with respect to the apparatus 10, like elements of structure and function will be identified by similar 10's digits of numbers in the 100 series. Hence, in those instances in which the like elements of structure of the embodiment 110 function in the manner already described with respect to the embodiment 10, a redundant description can be avoided.

In the embodiment of the synchronizing apparatus 110 the automatic means or servomechanism 118 includes a motor driver 140 connected with a separate rotatable threaded shaft 142 that is actuated by a plurality of stepped up gears 141*a, b, c* and *d* to provide a mechanical advantage. Although not illustrated, the gears 141 and a rotatable shaft 142 will be suitably supported to enable them to perform their rotating functions.

The actuated traveller 136 rides in opposite directions along the length of the threaded shaft 142 during the rotation thereof and also moves along and relative to the covering sleeve or sheath 130 that houses the throttle control cable 128. The traveller 136 is maintained in a substantially fixed centered or normal position between relatively spaced supports 148 by a yieldable mechanism that includes a pair of opposed yielding means in the form of springs 146. The desired predetermined opposed but yieldable resistance to movement of the traveller 136 applied thereto by the urging spring means 146 is of such force as to resist the movement of the traveller 136 from its normal centered position between the supports 148 when the traveller rides along shaft 142 in response to the rotation thereof.

The support members 148 are fixed to the housing 130 in their spaced relation such that when the traveller 136 is moved in accordance with the operation of the drive motor 140 and the shaft 142, it presses against the spring 146 in the direction of such movement. The springs 146 apply a predetermined resistance that is greater than the sum of both the movement of the traveller 136 and of the normal movement of the cable 128 under the influence of the manual throttle 124. Therefore, the support member 148, located in the direction of the traveller movement, will move with the traveller as a unit. This results in the corresponding movement of the connected covering sleeve or housing 130. This is analogous to the resistance applied by the yielding structure 46 and 48 of the apparatus 10 previously described.

The housing 130 is guided in its movement by a fixed support 138. Depending upon the direction of movement of the covering housing 130, it will either increase or decrease the slack play or looseness 137 in the connecting structure 120 to move the cable 128 with it. Because the manual throttle 124 of the slave engine 114 is restrained by screw 133 against unwanted or accidental movement, and further because the covering housing 130 is fixed from movement in the support 132, it must move in the area of its slack or lost motion 137. The combination of the movement of the covering sleeve or housing 130 and of the frictional engagement between it and the interior cable 128, physically causes the cable 128 to move with the covering housing 130.

Accordingly, the cable 128, forming a part of the connecting means 120, and being operatively connected with the engine throttle 122, adjustingly moves the same to vary the operation of the slave engine 14 in accordance with the signals received by the motor control amplifier 54 from the comparator 52. If the slave engine 14 is operating slower than the master engine 12, the drive motor 140 will rotate shaft 142 to move the traveller 136 in a direction toward the slave engine throttle 122. If the slave engine 14 is operating faster than the master engine 12, the traveller 136 will be actuated by the motor 140 and shaft 142 to move the traveller 136 in a direction opposite from the engine throttle 122 to move the throttle with it to slow the engine 14 into synchronism with the master engine 12.

In the event a condition occurs that requires the user to overcontrol the automatic operation of the servomechanism 118, the throttle 124 is immediately moved in the direction necessary to remedy the condition. This merely requires the user to apply a force to the throttle 124 to sufficiently overcome the restraint applied against its movement by the restraining means 133 to move the throttle 122 by way of the direct connecting cable 128.

The resistance applied by the yieldable springs 146 to the displacement of the traveller 136 from its normal position is also sufficient to resist such displacement in the response to the overcontrolling operation of the throttle 124. As a matter of fact, if both the traveller 136 and throttle 124 are being operated concurrently in the same direction, the normal resistance of the springs 146 is predetermined to resist the sum of their forces against displacement of the traveller 136 from its normal position. However, when the force applied to the throttle 124 and to the cable 128 exceeds the predetermined resistance of the springs 146 as imparted by the cable 128 to the covering sheath or housing 130, the springs yield to permit the covering housing 130 to continue to move in the direction of the cable and of the force applied to and by the overcontrolling throttle 124.

The details of the power source 50, the comparator 52 and related mechanisms described with respect to the embodiment 10 have been omitted from the illustration and description of the present embodiment to avoid redundant explanations. However, from what has been previously described, it is apparent that their application to and use with the apparatus 110 and subsequent embodiments to be described will be recognized by those who are skilled in the art.

Figure 4:
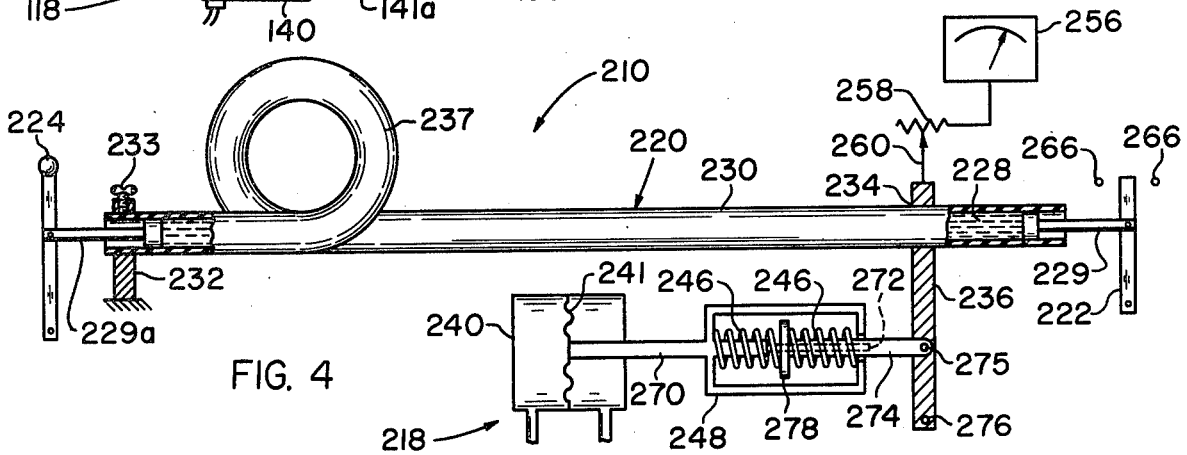
FIG. 4 is a diagrammatic view of still another synchronizing apparatus.

Referring to FIG. 4, the synchronizing apparatus there shown is generally identified by the numeral 210. Like elements of structure of the apparatus 210 that correspond to those previously described in connection with the apparatus 10 and 110 are similarly numbered with corresponding 10's digits but in the 200 series of numbers. Once again, as in the illustration of the apparatus 110, the details of structure necessary to control the automatic operation of the servomechanism 218 are not shown. Rather, it is believed that their application and use with the present embodiment should be apparent to those who are skilled in the art from the description of the apparatus 10.

In the apparatus 210 the servomechanism 218 comprises a fluid drive motor 240 that is fluid operated in response to the flow of fluid on opposite sides of a piston or yieldable baffle 241. This produces a consequent movement of the traveller 236 that is fixedly mounted to an elongated covering sleeve or housing 230 forming a part of the controller or connecting means 220.

Included in the servomechanism 218 is an actuated link 270 that has a narrowed extension 272 thereof that slidingly moves and is guided within an opening defined within a corresponding link 274. The link 274 is pivotally mounted at 275 to pivotally actuate the traveller 236 about the pivot 276. Its opposite end has an abutment 278 fixed to it. The abutment 278 moves within an enclosure 248 that houses a pair of oppositely acting springs 246. The arrangment of the housing 248 and the springs 246 operating with equal forces on opposite sides of the abutment 278 constitutes a yielding structure that is substantially the same in function to that of the yielding structure 146 and 148 as described in connection with the traveller 136 of the prior embodiment 110.

The engine throttle 222 of the slave engine 14 is connected through an actuating piston 229 with a fluid 228 that is contained and enclosed within the sleeve-like covering conduit or housing 230. The opposite end of the conduit 230 is closed by a corresponding piston **229*a* that, in turn, is also connected with the manually controllable throttle 224**.

The conduit 230 is maintained fixed against movement at its one end proximate the manual throttle 224 within the support 232. A restraint or braking force may be applied against undesired or accidental movement of the manual throttle 224 by a wing nut 233 in the manner described in connection with the prior embodiments. The connecting means 220, by way of the conduit 230, is relatively slack as depicted by the loop 237. The traveller 236 may be provided with a contact 260 for movable engagement with the rheostat 258 to provide a visual indication on the range indicator 256 of the condition of the servomechanism correction of the slave engine 14 of which the engine throttle 222 forms a part.

The present embodiment teaches a method and means for controlling the operation of the slave engine 14 by way of its engine throttle 222 by the use of a fluid actuator. Thus, when an asynchronous condition is sensed by the comparator 52, the same will signal the operation of a fluid pump connected with the driver 240 to provide a supply of fluid to selected ones of the opposite sides of the piston or baffle 241 therein. Depending upon whether the slave engine 14 is operating slower or faster than that of the master engine 12, the piston or baffle 241 may be moved to the right to increase the speed of the slave engine by supplying actuating fluid to the left side of the baffle 241 to move the engine throttle 222 of the right. If the slave engine 14 is operating faster than that of the master engine 12, the engine lever 222 will be moved to the left by fluid power being applied to the right side of the baffle or piston 241.

When fluid is applied to the left side of the baffle piston 241, the link 270 is moved in a corresponding direction to the right. This causes the support enclosure 248 to apply a force against the left-most spring 246. As was described in connection with the prior embodiments the yielding means 248 and 246 apply a restraining force of a predetermined extent equal to at least the normal force of movement of the driver 240 and the normal force of adjustment setting of the engine throttle 222 by the manual throttle 224.

Therefore, when the normal force applied by the movement of the piston or baffle 241 to the link 270 moves the housing 248 to the right, the spring 246 will not compress. Rather, it will apply an equal moving force to the abutment 278 to cause the link 174 to operate the traveller to the right toward the engine throttle 222. This movement of the traveller 236 conjointly moves the connecting means 230 with it. Because the conduit 230 is restricted from movement at 232, it elongates in the direction of the engine lever 222. Since the fluid 228 is entrapped therewithin, it forms a solid connection with the piston 229 to cause the engine lever 222 to move to the right and thereby speed up the operation of the slave engine 214 to bring it into synchronism with the relatively faster operating master engine 12.

In opposite manner in the event the slave engine 14 is leading that of the master engine 12, the baffle or piston 241 will be moved to the left by the application of fluid to the right side thereof. This will result in the consequent movement of the traveller 236 to the left and the concurrent movement of the conduit 230 with the entrapped fluid 228 therein to the left causing the piston 229 connected to the engine throttle 222 to similarly move to the left. This will reduce the speed of the slave engine 14 to synchronize its operation with that of the master engine.

From the description of the movement of the conduit 230 of the controller or connecting means structure 220 and the entrapped fluid 228 therewithin and the pistons 129 and **129*a*, it should be clear the controller functions much in the nature of the solid direct connecting wire cables 28 and 128 of the prior embodiments 10 and 110 respectively. Therefore, when it becomes necessary for the pilot or user to initially set the operation of the slave engine 14 in substantial synchronism with the master engine 12, the manual throttle 224 is moved in the appropriate direction. This causes its piston 229*a* to apply a force against the entrained fluid 228 to serve as a direct linkage between the manual throttle 224, the piston 229 and the engine lever 222**.

Should a time occur when it is necessary to overcontrol the operation of the servomechanism 218 by the manual throttle 224, the same is moved in the required direction to bring the slave engine 14 under control of the pilot or user. When the manual throttle 224 is moved in an emergency condition, it applies a force sufficient to overcome the restraint against its movement by the braking means 233. The movement of its piston **229*a* against the entrapped fluid 228 produces a consequent movement of the piston 229 and the engine lever 222. This arrangement of structure assures a constant ability of the present apparatus 210 to provide a dominant overcontrol, by way of the controller or connecting mechanism 220, over the operation of the automatic servomechanism 218**.

If during the overcontrolling operation of the slave engine 14 by way of the manual throttle 224 the slave engine throttle 222 shall have come into abutment with one of the relatively spaced stops 266, continued movement of the manual throttle 224 in excess of the normal forces applied by the yielding springs 246 will cause the conduit 230 to move in the direction of the force applied to the manual throttle 224 to thereby move with it the traveller 236. The movement of the traveller 236 in the direction of movement of the manual throttle 224 is then imparted to the link 274. Should the force applied to the manual throttle 224 exceed the normal force of the springs 246, the springs then will compress permitting the conduit 230 to move in opposition to the resistance afforded by the yielding structure 246 and 248.

From what has been described it will be seen that at all times and during all periods of operation of the embodiment of the apparatus 210 the manual throttle 224 is constantly provided with the ability to dominate and overcontrol the operation of the automatic servomechanism 218 through the same connecting or controller structure 220 that serves to connect the servomechanism 218 with the engine throttle 222 of the slave engine 14. This arrangement, whether in accordance with the structures described with respect to the apparatuses 10 and 110 or in accordance with the fluid operation as described in connection with the present embodiment 210, still permits and affords dominant overcontrol of the servomechanism by the manual throttle 224 over the slave engine 14. This is true even though the slave engine may be subject to concurrent operation and control by the servomechanism 218.

Figure 5:
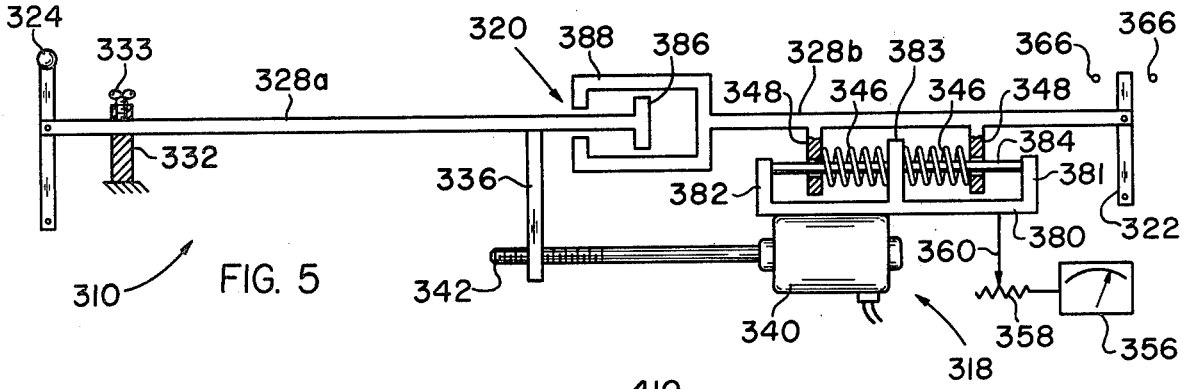
FIG. 5 is a diagrammatic view of a further synchronizing apparatus.

Referring to FIG. 5, the embodiment of the synchronizing apparatus there shown in generally identified by the numeral 310. As in the prior described embodiments, elements corresponding to such prior described embodiments will be identified by the same 10's digits. All numbers will be in the 300 series.

The apparatus 310 includes an automatically operated servomechanism generally identified by the numeral 318 and a controller or connector mechanism generally identified by the numeral 320. The servomechanism 318 includes a driver in the form of a motor 340 that is operated in response to the differences or asynchronous operations of the slave engine 14 with respect to the master engine 12 as sensed by the comparator 52 described with respect to the embodiment 10. The drive motor, when rotated, rotates a threaded shaft 342 that is threadedly connected with an extension 336. The extension 336 may be formed integral with or may be connected for conjoint movement with a rigid cable 328*a* having a second rigid cable part 328*b*. The rigid part members 328*a* and *b* form a part of the controller or connecting means 320.

Supported with the driver motor 340 is a bracket 380 having three relatively spaced uprights 381, 382 and 383 that support between them as a rigid part thereof a support element 384. Mounted on the support element 384 are a plurality of oppositely disposed yieldable elements 346 each of which abuts against the common support 383 therebetween and engage with collars 348 at their opposite ends.

The rigid cable member 328*a* is provided with an enlargement 386 that is adapted to move freely within a housing afforded by an encompassing enclosure 388 formed as an enlargement on the rigid cable member 328*b*. The rigid cable member 328*b* is pivotally connected with the throttle 322 of the slave engine 14 and is limited in its movement by the stops 366.

In operation the slave engine 14 is initially set to operate synchronously with the master engine 12 by the manual movement of the throttle 324. Movement of the throttle 324 is transmitted along the rigid member 328*a* to the connecting extension 336, across the rotatable shaft 342, and to the drive motor 340. This movement is further transmitted to the bracket 380 and across the yieldable structure afforded by the springs 346.

As in the prior described embodiments, the springs 346 have a predetermined tension affording a resistance to relative movement of the bracket 380 with respect to the rigid cable member 328*b*. The force of such resistance is greater than that normally applied by the throttle 324 to manually adjust the engine throttle 322. Hence, the support 383 will remain in a centered position with respect to the collars 348 thereby causing the cable 328*b* to move in correspondence with the manual throttle 324 thereby to correspondingly operate the slave engine throttle 322.

After the slave engine 14 is initially set in the manner described, the servomechanism 318 then automatically performs its controlling functions upon the engine throttle 322 of the slave engine 14 to retain the slave engine 14 in synchronism with the master engine 12. When the comparator 52 senses a difference in operation of the engines 12 and 14, it automatically signals the operation of the drive motor 340. In the event the slave engine 14 is operating slower than that of the master engine 12, it will be necessary to increase its speed. This is accomplished by rotating the shaft 342 so as to cause the bracket 380 to move to the right because the manual throttle 324 is restrained from movement by the braking force applied to it at the adjustable screw 333 against accidental displacement with respect to the support 332.

Accordingly, the drive motor 340 is caused to move to the right in response to the rotation of the shaft 342 in the extension 336. Under normal conditions of operation the movement of the drive motor 340 and its bracket 380 to the right will be resisted by the springs 346 to cause the rigid cable member 328*b* to similarly move to the right to operate the engine throttle 322 in the same direction to speed the operation of the slave engine 14.

In the event the slave engine 14 is operating faster than the master engine 12, the motor 340 will rotate in the opposite direction causing it to move relative to and toward the extension 336 because its threaded shaft moves to the left through the extension. This will move the bracket 380, and because of the resistance of the springs 346, the rigid cable member 328*b* will correspondingly move to the left actuating the engine throttle 322 to the left and thereby slowing the operation of the slave engine 14.

All of the above recognizes that the rigid cable member 328*a* is restrained from movement with the drive motor 340 and its bracket 380. However, should a condition occur that requires the overcontrol of the slave engine 14 by the pilot or user, the manual throttle 324 is then moved with a force sufficient to overcome the restraint applied to its movement by the braking means 333. This will move the extension 336 to move the threaded shaft 342 and the cable 328*a* with it. Because the servomechanism forms a bridge and interconnection across the rigid cable members 328*a* and 328*b*, the motor 340 and the bracket 380 will move in the direction of movement of the manual throttle 324. During normal movements the springs 346 will absorb such forces and exert a similar movement against the rigid member 328*b* to actuate the engine throttle 322 in the direction of movement of the throttle 324.

In light of the above, it should be clear that the connecting means 320 and the servomechanism 318 cooperate to apply a connection between the manual throttle 324 and the slave engine throttle 322. However, in the event that there is resistance to movement of the rigid cable member 328*b* in correspondence with and according to the movement of the rigid cable member 328*a* responding to that of the manual throttle 324, the enlargement 386 of the cable member 328*a* will move within the housing 388 in the same direction as that of the manual throttle 324 to take up the slack or lost motion connection between them.

If resistance to movement of the throttle 324 is sufficiently great, the enlargement 386 will move within the housing 388, but never reach abutment against one of the adjacent facing walls of the housing 388. During application of continued moving force to the throttle 324, the springs 346 will yield and compress in response to the force in excess of the normal resisting force of such springs to enable the rigid cable member 328*b* to move directly with and in correspondence to the movement of the cable 328*a* response to the force exerted thereon by the manual throttle 324.

In this sense the yielding structure 346 and 348 functions in a manner similar to the aforedescribed yielding structures of the prior embodiments. The slave engine throttle 322 is, at all times, subject to the direct and dominant overcontrol of the manual throttle 324 by way of the rigid cable members 328*a* and 328*b*. This is true even during concurrent control of the slave engine throttle 322 by the sercomechanism 318.

Figure 6:
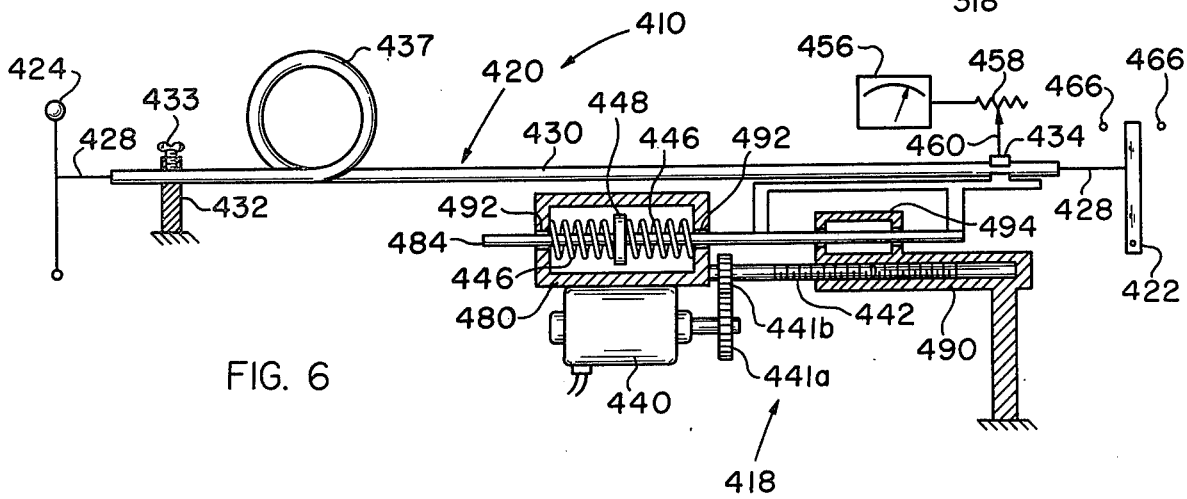
FIG. 6 is a diagrammatic view of still a further synchronizing apparatus.

FIG. 6 illustrates a further embodiment of a synchronizing apparatus generally identified by the numeral 410. The apparatus 410, including elements similar to those previously described with respect to prior embodiments are, therefore, numbered in the 400 series with the 10's digits thereof corresponding to those of like elements of prior embodiments.

The servomechanism 418 includes a drive motor 440 for rotating a plurality of gears 441*a* and 441*b*. The gear 441*b* is connected with a threaded shaft 442 that is adapted to thread into and out of or relative to a rigid support or standard 490. As the shaft 442 moves relative to the standard 490, its drive motor 440 moves with it and carries with it a traveller bracket 480 that includes threrewithin a yielding structure comprising a plurality of springs 446 and a collar 448 that is normally centered by the springs within the bracket 480.

The traveller bracket 480 is provided with openings 492 at its opposite ends to guidingly receive a support element 484 for sliding movement therein. The springs 446 are mounted about the support 484 while the collar 448 is rigidly connected to it. The support element 484 extends beyond the bracket 480 and is guided for relative movement within a guide 494 that forms a part of the standard 490.

The support 484 is thereafter connected at 434 with the controller or connecting means 420 at the covering sleeve or sheath 430 for conjoint movement. The covering 430 houses the cable 428 that moves in sliding frictional engagement within the interior of the covering 430. The connecting means 420 connects the manual throttle 424 directly with the engine throttle 422 of the slave engine 14 by means of the cable 428 and is provided with a degree of slack or looseness as illustrated by the loop 437. The covering 430 and the manual throttle 424 are restrained against the relative movement with respect to a support 432 by an adjustment braking means 433.

The through flexible cable 428 directly connects the manual throttle 424 at all times with the engine throttle 422 of the sleeve engine 14 thereby assuring direct and intimate dominating control of the slave engine 14 regardless of what other movements may be imparted to such slave engine by way of the automatic operation of the servomechanism 418. Hence, when power is illustrated at 50 for the operation of the servomechanism 418, the slave engine 14 is initially adjusted for substantially synchronous operation with the master engine 12 by the manipulation by the pilot or user of the manual throttle 424. Thereafter, a braking force or restraint is applied to the manual throttle 424 as by the adjustment means 433 to inhibit or restrain the manual throttle from accidental displacement. In like manner the covering sheath or sleeve 430 housing the cable 428 also is restrained from movement proximate the manual throttle 424 within the support 432.

During the operation of the automatic synchronizing servomechanism 418, if the slave engine 14 is operating slower than that of the master engine 12, an appropriate signal will be directed to the drive motor 440 to rotate the shaft 442 to move inwardly with respect to the standard 490. This will cause the bracket 480 to move to the right in a direction to compress the springs 466 therewithin. However, as previously described with respect to other embodiments, the yielding structure and the predetermined resistance of the springs normally is such as to resist ths sum of the normal forces applied by the threaded screw 442 and the manual throttle 424. Therefore, the bracket 480 will move to the right with the threaded screw 442 to cause the covering 430 connected with it at 434 also to move to the right. This rightward movement takes up some of the slack 437 in the controller or connector structure 420 to cause the cable 428 to move to the right thereby actuating the engine throttle 422 to increase the speed of the slave engine 14.

Should the reverse be necessary, namely, in the event the slave engine 14 is operating faster than the master engine 12, it will be necessary to slow it. This is accomplished in the reverse manner of that described above by the operation of the drive motor 440 causing the shaft 442 to thread outward from the standard 490 thereby moving the covering 430 and the interior cable 428 to the left. This results in the leftward movement of the engine throttle 422 thereby slowing the slave engine 14 into synchronous operation with the master engine 12.

Should it be necessary for the user to overcontrol the automatic operation of the servomechanism 418, it is only necessary for the pilot or user to overcome the restraint or braking force applied against the cable 428 by the adjustment means 433. When this is done, the cable 428 will move in the direction of the movement of the manual throttle 424 to correspondingly move the engine throttle 422. In the event the movement of the engine throttle 422 is interrupted or halted by its abutment with one of the stops 466, further movement of the manual throttle 424 is absorbed by the yielding structure 446 and 448 in the manner as described with respect to the apparatus 10.

The application of an overcontrolling force to the throttle 424 in excess of the resistance of the yielding springs 446 will cause the slide support 484 to move with the covering sheath 430 in the opposite direction of the manual throttle 424 as described in the embodiment 10. This will move the collar 448 in opposition to the resistance of the springs 446 thereby permitting the yielding structure to absorb the movement of the manual throttle without damage to the connected servomechanism 418.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for synchronizing the operation of at least a slave engine with that of a master engine, manual and engine throttles movably connected with and for adjusting the operation of each of said engines, servo means operable to adjust said slave engine throttle to synchronize it with the operation of said master engine throttle when the master and slave engines operate asynchronously, and means connecting said slave engine throttle with its respective manual throttle including operable means connecting said slave engine manual throttle with said slave engine throttle for operation of said slave engine throttle directly in response to the operation of said respective manual throttle and moving means releasably moving said operable means and connected with and between said servo means and said operable means to move to adjust said operable means and said slave engine throttle in response to the operation of said servo means, and resiliently yieldable means connected between said moving means and said servo means and applying a predetermined resistance to the movement of said moving means in response to the operation of said slave engine manual throttle until the force applied by said slave engine manual throttle exceeds said predetermined force thereby enabling said slave engine and its throttle to be independently manually overcontrolled and adjusted by the movement of its respective manual throttle without the application of anything more.

2. In an apparatus as in claim 1, said connecting means connecting said slave engine with said servo means and its respective manual throttle for independent adjustment by said servo means and by its respective manual throttle.

3. In an apparatus as in claim 1, said connecting means connecting said servo means with such slave engine for adjustment of the operation of said slave engine concurrently with the adjustment of the operation of said slave engine by the movement of said respective manual throttle.

4. In an apparatus as in claim 3, said operable means including a flexible connection between said slave engine and its respective manual throttle.

5. In an apparatus as in claim 3, said connecting means including rigid members connected between said slave engine and its respective manual throttle.

6. In an apparatus as in claim 1, said moving means being a housing connected with said servo means, and said operable means being movable in said housing connecting said slave engine with its respective manual throttle to adjust said slave engine in accordance with the operation of its respective manual throttle, said housing transmitting to said movable operable means the movement operation of said servo means to adjust said slave engine independently of the adjustment of said respective manual throttle.

7. In an apparatus as in claim 1, said operable means including a cable directly connecting said slave engine with said respective manual throttle for direct and constant control of said slave engine and said moving means being about said cable and being connected with said servo means for movement by said servo means to move said cable therein and to adjust said slave engine in accordance with the operation of said servo means.

8. The method of synchronizing at least a slave engine with that of a master engine in which each engine has a respective manual throttle, setting the master engine at a selected operation by adjustment of its respective manual throttle, setting the slave engine at approximately the selected operation of the master engine by adjustment of its respective manual throttle, restraining the slave engine manual throttle from undesired movement, automatically operating a mechanism connected with the slave engine through a connection that also connects the respective manual throttle with the slave engine to adjust the slave engine for synchronous operation with the master engine, and moving the slave engine's manual throttle and thereby overcontrolling the operation of the mechanism.

9. In an apparatus for synchronizing a plurality of engines in which at least one of said engines is a slave engine and another is a master engine with which the slave engine is synchronized, servo means for automatically operating said slave engine synchronously with said master engine, manual throttles for manually operating respective ones of said engine throttles individually, movable means connecting said slave engine simultaneously with said servo means and with its respective manual throttle such that said movable connecting means moves in response to said respective manual throttle and said servo means automatically operates said slave engine synchronously with said master engine, and resiliently yieldable means connected between said movable connecting means and said servo means to apply a desired resistance to the movement of said movable connecting means in response to the movement of said respective manual throttle until the force applied by said manual throttle exceeds said desired resistance to thereby dominate and independently manually and without more overcontrol the automatic operation of said slave engine by said servo means, said movable connecting means including a covered flexible cable in which said flexible cable is connected with said slave engine and said covering is connected with said servo means for operation thereby to operate said flexible cable covered therein to move and operate said slave engine automatically in response to the operation of said servo means, and said flexible cable being connected with said respective manual throttle of said slave engine for domination and overcontrol of said slave engine by said respective manual throttle.

10. In an apparatus as in claim 9, said yieldable means applying a predetermined resistance to the operation of said covering of said connecting means by said respective manual throttle until the force applied by said respective manual throttle exceeds said predetermined resistance.

11. In an apparatus as in claim 10, said flexible cable being partially covered.

12. In an apparatus as in claim 9, said servo means comprising a slide connected with said covering, a driver, means movable by said driver to move said covering for operation of said flexible cable therein, and said yieldable means between said driver and slide enabling said slide to move relative to said driver in response to overcontrolling operation of said flexible cable by said respective manual throttle of said slave engine.

13. In an apparatus for synchronizing the operation of at least a slave engine with a master engine, means to automatically operate the slave engine in synchronism with the master engine, a throttle to manually operate the slave engine, and connecting means between said manual throttle and sid automatic means and slave engine, said connecting means comprising a flexible cable providing a connection between said manual throttle and its respective slave engine to afford direct manual throttle control over the slave engine and means movable in sliding frictional engagement with and relative to said cable, resilient yieldable means applying a predetermined restraint to the movement of said manual throttle and cable, said automatic means being connected with said movable means to move the same and said cable conjointly to operate the slave engine in synchronism with the master engine while enabling the operation of the slave engine to be overcontrolled without more by said manual throttle operated in excess of the predetermined restraint applied to it to cause said cable to slide relative to said moving means.

14. In an apparatus as in claim 13, said movable means being a covering enclosing at least a portion of said cable.

15. In an apparatus as in claim 13, said yieldable means connecting said automatic means and movable means for conjoint movement by applying a desired resistance against relative movement therebetween and yieldable in response to the overcontrolling operation of the slave engine by said manual throttle to enable relative movement between said automatic means and said movable means when the force applied by the manual throttle to the cable and said movable means by said frictional engagement therebetween exceeds said desired resistance of said yieldable means.

16. In an apparatus as in claim 13, said automatic means including a fixed support, a traveller fixed to said movable means for conjoint movement therewith, a driver movable with and relative to said traveller and having means movable relative to said fixed support to control the movement of said traveller and said movable means, and said yieldable means between said driver and traveller applying a desired resistance against the relative movement between said driver and traveller so as to transmit movement to said traveller and movable means from said driver and to enable movement of said traveller and sliding means relative to said driver when the force applied by said manual throttle to said cable and movable means exceeds the resistance of said yieldable means.

* * * * *

UNITED STATES PATENT AND TRADEMARK OFFICE

CERTIFICATE OF CORRECTION

PATENT NO. : 4,435,961

DATED : March 13, 1984

INVENTOR(S) : GLENN D. STEWART

It is certified that error appears in the above-identified patent and that said Letters Patent are hereby corrected as shown below:

Claim 13, line 7, change "sid" to --said--

Signed and Sealed this

*Twenty-ninth* Day of *May 1984*

[SEAL]

*Attest:*

GERALD J. MOSSINGHOFF

*Attesting Officer*

*Commissioner of Patents and Trademarks*